US008739545B2

(12) United States Patent
Cant et al.

(10) Patent No.: US 8,739,545 B2
(45) Date of Patent: Jun. 3, 2014

(54) BURNER FOR A GAS TURBINE ENGINE

(75) Inventors: Andrew Cant, Grantham (GB); Paul Headland, Lincoln (GB); Daniel Leggett, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 866 days.

(21) Appl. No.: 12/768,078

(22) Filed: Apr. 27, 2010

(65) Prior Publication Data

US 2010/0275602 A1 Nov. 4, 2010

(30) Foreign Application Priority Data

Apr. 29, 2009 (EP) ..... 09159093

(51) Int. Cl.
*F02C 7/22* (2006.01)

(52) U.S. Cl.
USPC ..... 60/748; 60/737; 60/39.463; 60/39.465; 60/746

(58) Field of Classification Search
USPC ..... 60/737, 39.463, 39.465, 740, 742, 746, 60/747, 748; 431/8; 239/399
See application file for complete search history.

(56) References Cited

U.S. PATENT DOCUMENTS

| | | | | |
|---|---|---|---|---|
| 5,319,935 | A * | 6/1994 | Toon et al. | 60/733 |
| 5,450,724 | A | 9/1995 | Kesseli | |
| 5,451,160 | A | 9/1995 | Becker | |
| 6,151,899 | A * | 11/2000 | Park | 60/748 |
| 6,253,555 | B1 * | 7/2001 | Willis | 60/737 |
| 6,470,684 | B2 * | 10/2002 | Wilbraham | 60/737 |
| 6,532,726 | B2 * | 3/2003 | Norster et al. | 60/39.281 |
| 6,688,109 | B2 * | 2/2004 | Hein | 60/748 |
| 2001/0027637 | A1 | 10/2001 | DePietro et al. | |
| 2003/0152880 | A1 | 8/2003 | Eroglu et al. | |
| 2006/0257807 | A1 | 11/2006 | Hicks | |

FOREIGN PATENT DOCUMENTS

| | | | |
|---|---|---|---|
| EP | 0722065 | A2 | 7/1996 |
| EP | 1835231 | A1 | 9/2007 |
| EP | 1892469 | A1 | 2/2008 |
| EP | 1921376 | A1 | 5/2008 |
| EP | 1995521 | A1 | 11/2008 |
| EP | 2068076 | A2 | 6/2009 |
| GB | 2435508 | A | 8/2007 |
| GB | 2453114 | A | 4/2009 |
| RU | 2000116248 | A | 9/2002 |
| RU | 2009147021 | A | 6/2011 |
| RU | 2010122334 | A | 12/2011 |
| WO | WO 2004057236 | A2 | 7/2004 |
| WO | WO 2007144209 | A1 | 12/2007 |

* cited by examiner

*Primary Examiner* — Phutthiwat Wongwian
*Assistant Examiner* — Steven Sutherland

(57) ABSTRACT

A burner for a gas turbine engine is provided. The burner includes a radial swirler for creating a swirling fuel/air mix, a combustion chamber where combustion of the swirling fuel/air mix occurs, and a pre-chamber located between the radial swirler and the combustion chamber. The radial swirler includes a plurality of vanes arranged in a circle, generally radially inwardly extending flow slots are defined between adjacent vanes in the circle, each flow slot includes a radially outer inlet end, a radially inner outlet end, first and second generally radially inwardly extending sides provided by adjacent vanes, and a base and top. A flow slot includes a first gas fuel injection hole in its base and a flow slot includes a second gas fuel injection hole in its first side wherein the amounts of gas fuel injected via the first and second gas fuel injection holes are independently variable.

9 Claims, 8 Drawing Sheets

BURNER FOR A GAS TURBINE ENGINE

CROSS REFERENCE TO RELATED APPLICATIONS

This application claims priority of European Patent Office application No. 09159093.5 EP filed Apr. 29, 2009, which is incorporated by reference herein in its entirety.

FIELD OF INVENTION

This invention relates to a burner for a gas turbine engine.

BACKGROUND OF INVENTION

More particularly the invention relates to a burner for a gas turbine engine comprising: a radial swirler for creating a swirling fuel/air mix; a combustion chamber in which takes place combustion of the swirling fuel/air mix; and a pre-chamber located between the radial swirler and the combustion chamber, the radial swirler comprising a plurality of vanes arranged in a circle, generally radially inwardly extending flow slots being defined between adjacent vanes in the circle, each flow slot having a radially outer inlet end, a radially inner outlet end, first and second generally radially inwardly extending sides provided by adjacent vanes, and a base and top, in use of the burner fuel and air travelling along the flow slots from their inlet ends to their outlet ends so as to create adjacent the outlet ends the swirling fuel/air mix, a flow slot comprising a first gas fuel injection hole in its base and a flow slot comprising a second gas fuel injection hole in its first side.

A burner of this type is known wherein there is a first gas fuel injection hole in the base of every flow slot and two second gas fuel injection holes in the first side of every flow slot. In this known burner all the first and second gas fuel injection holes are supplied by one and the same gas fuel supply gallery of a gas fuel supply manifold.

It is desired to reduce the nitrogen oxides (NOx) and carbon monoxide (CO) emissions of this known burner.

SUMMARY OF INVENTION

According to the present invention there is provided a burner for a gas turbine engine comprising: a radial swirler for creating a swirling fuel/air mix; a combustion chamber in which takes place combustion of the swirling fuel/air mix; and a pre-chamber located between the radial swirler and the combustion chamber, the radial swirler comprising a plurality of vanes arranged in a circle, generally radially inwardly extending flow slots being defined between adjacent vanes in the circle, each flow slot having a radially outer inlet end, a radially inner outlet end, first and second generally radially inwardly extending sides provided by adjacent vanes, and a base and top, in use of the burner fuel and air travelling along the flow slots from their inlet ends to their outlet ends so as to create adjacent the outlet ends the swirling fuel/air mix, a flow slot comprising a first gas fuel injection hole in its base and a flow slot comprising a second gas fuel injection hole in its first side, characterised in that the amounts of gas fuel injected via the first and second gas fuel injection holes are independently variable.

BRIEF DESCRIPTION OF THE DRAWINGS

The invention will now be described, by way of example, with reference to the accompanying drawings, in which.

Figure 4:
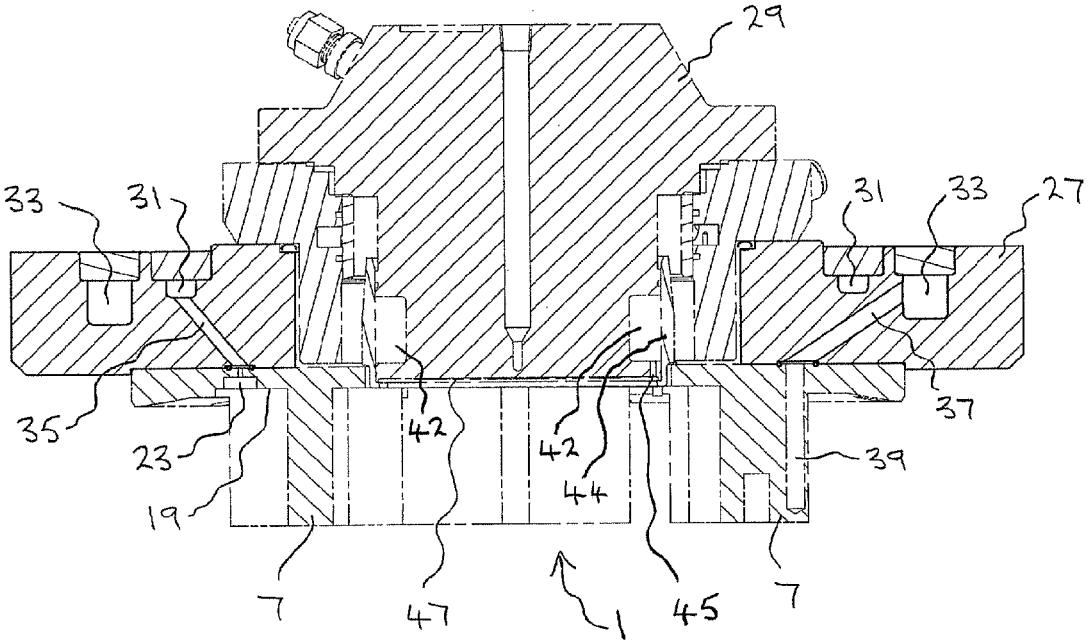
FIG. 4 is a cross section taken on a central vertical plane in FIG. 3, FIG. 4 showing in addition a part of the burner for providing pilot gas fuel to the burner.
Figure 5:
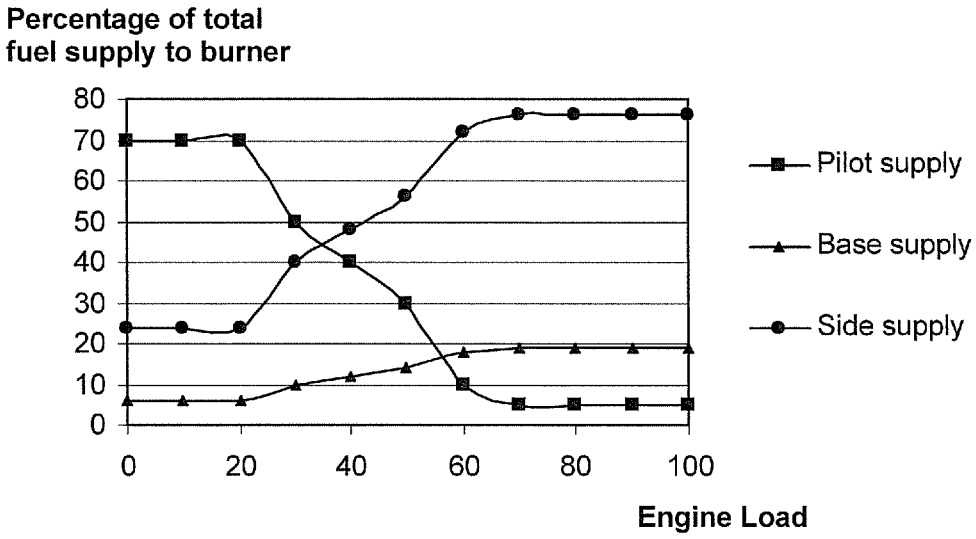
Figure 6:
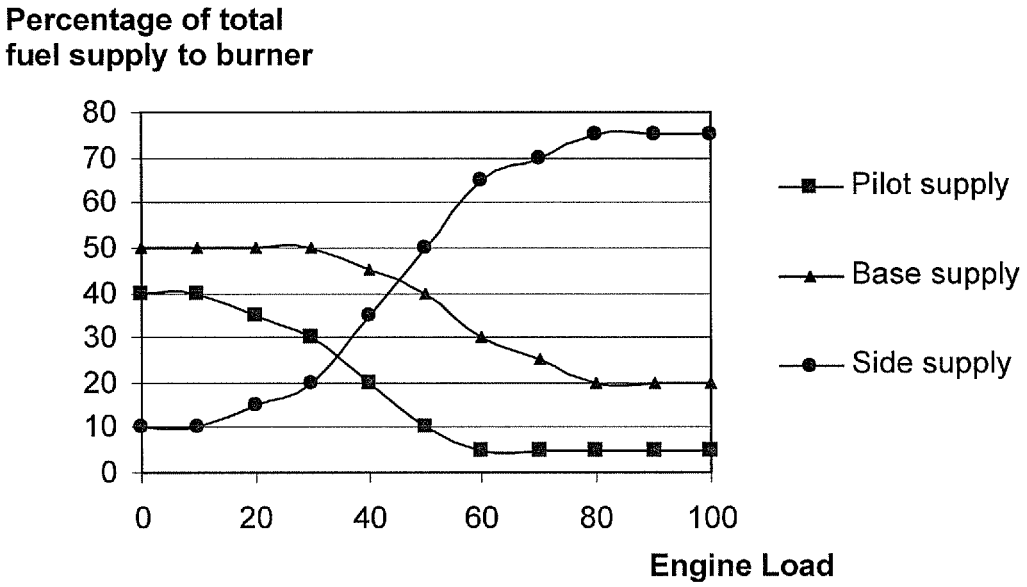
Figure 7:
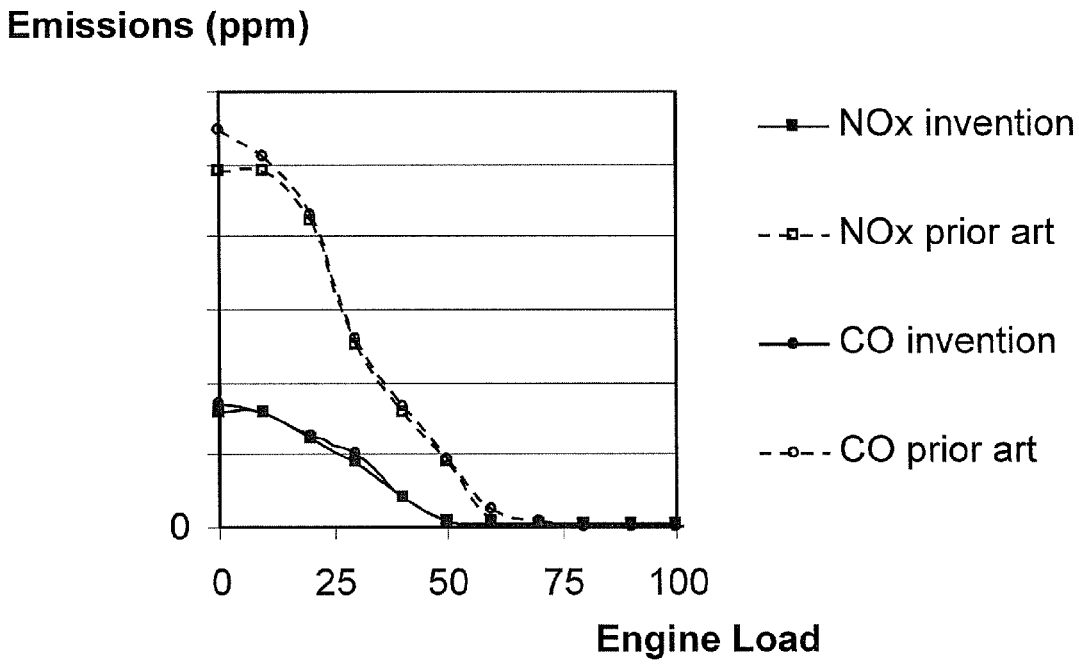

FIG. **4*a* is an enlarged view of a portion of that shown in FIG. 4**;

FIG. 5 is a graph for the known burner referred to above of (i) percentage of total fuel supply to the burner for the different fuel supplies to the burner, versus (ii) gas turbine engine load;

FIG. 6 is a graph for the burner in accordance with the present invention of FIGS. 1 to 4 of (i) percentage of total fuel supply to the burner for the different fuel supplies to the burner, versus (ii) gas turbine engine load; and FIG. 7 is a graph of NOx and CO emissions versus gas turbine engine load for the known burner and the burner in accordance with the present invention.

DETAILED DESCRIPTION OF INVENTION

Figure 1:
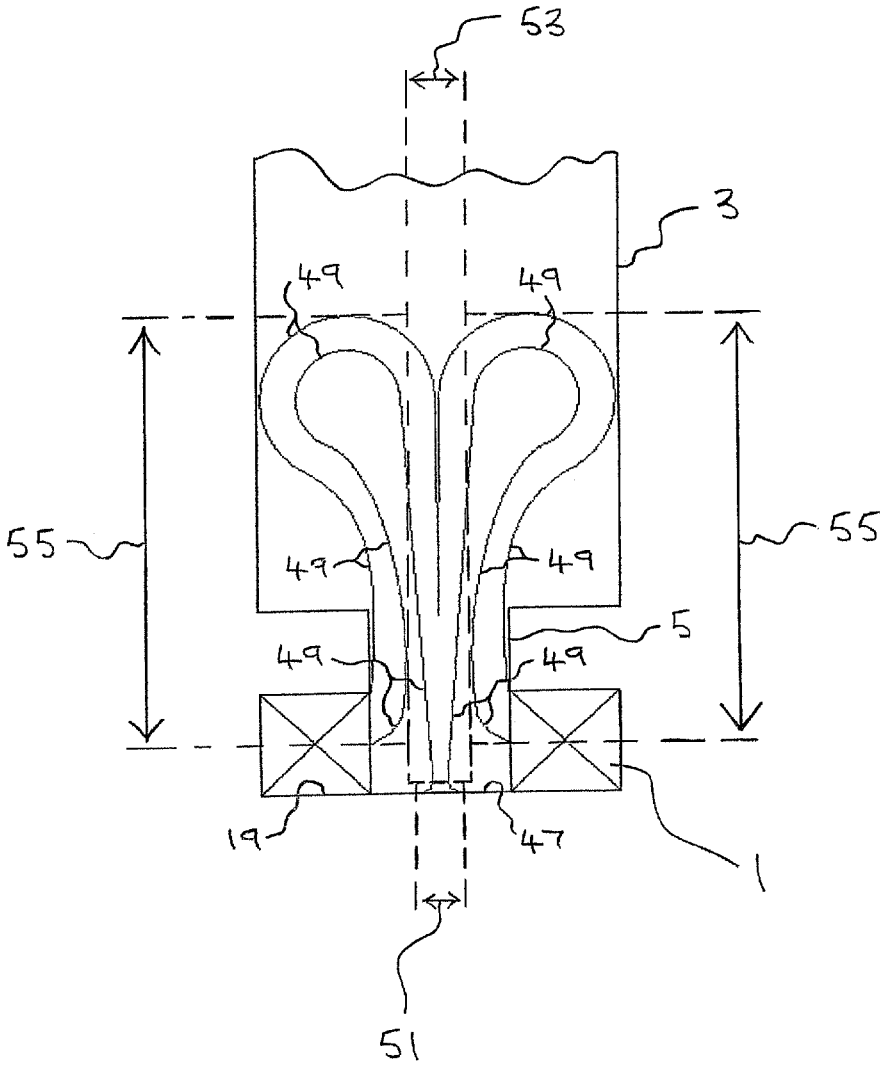
FIG. 1 is a schematic illustration of a burner in accordance with the present invention.

Referring to FIG. 1, the burner in accordance with the present invention comprises a radial swirler 1 for creating a swirling fuel/air mix, a combustion chamber 3 in which takes place combustion of the swirling fuel/air mix, and a pre-chamber 5 located between radial swirler 1 and combustion chamber 3.

Figure 2:
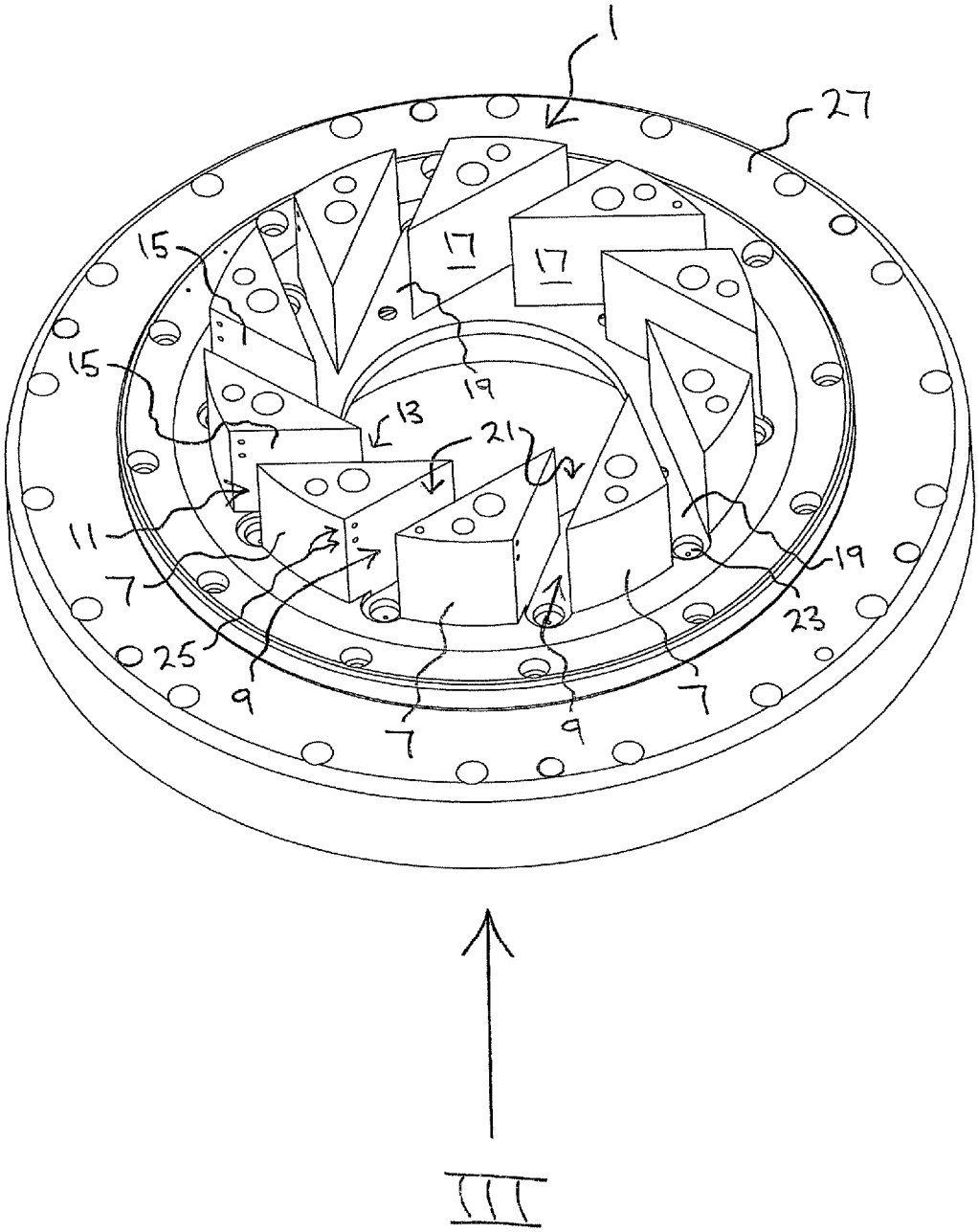
FIG. 2 is a perspective view of a radial swirler of the burner of FIG. 1 together with a gas fuel supply manifold for the radial swirler.

Referring to FIG. 2, radial swirler 1 comprises a plurality of wedge shaped vanes 7 arranged in a circle. The thin ends of the wedge shaped vanes are directed generally radially inwardly. The opposite broad ends of the wedge shaped vanes face generally radially outwardly. Adjacent vanes 7 in the circle define there between generally radially inwardly extending straight flow slots 9. Each flow slot 9 has a radially outer inlet end 11, a radially inner outlet end 13, first and second generally radially inwardly extending sides 15, 17 provided by adjacent vanes 7, and a base 19 and top 21. The base and top are spaced apart in a direction perpendicular to the plane of the circle in which the wedge shaped vanes 7 are arranged. Each flow slot 9 comprises a first gas fuel injection hole 23 in its base 19 and two second gas fuel injection holes 25 in first side 15 of the flow slot. First injection hole 23 is located at inlet end 11 of the flow slot. The two second injection holes 25 are located one above the other adjacent both inlet end 11 and top 21 of the flow slot.

In use of radial swirler 1: (i) air is supplied to inlet ends 11 of flow slots 9, (ii) the air travels generally radially inwardly along flow slots 9 where it combines with gas fuel from first and second injection holes 23, 25, and (iii) the fuel/air mix emerges from outlet ends 13 of flow slots 9 so as to create adjacent the outlet ends a swirling fuel/air mix.

FIG. 2 also shows a gas fuel supply manifold 27 for radial swirler 1. Gas fuel supply manifold 27 is annular in form and supplies the gas fuel to both first and second gas fuel injection holes 23, 25.

Figure 3:
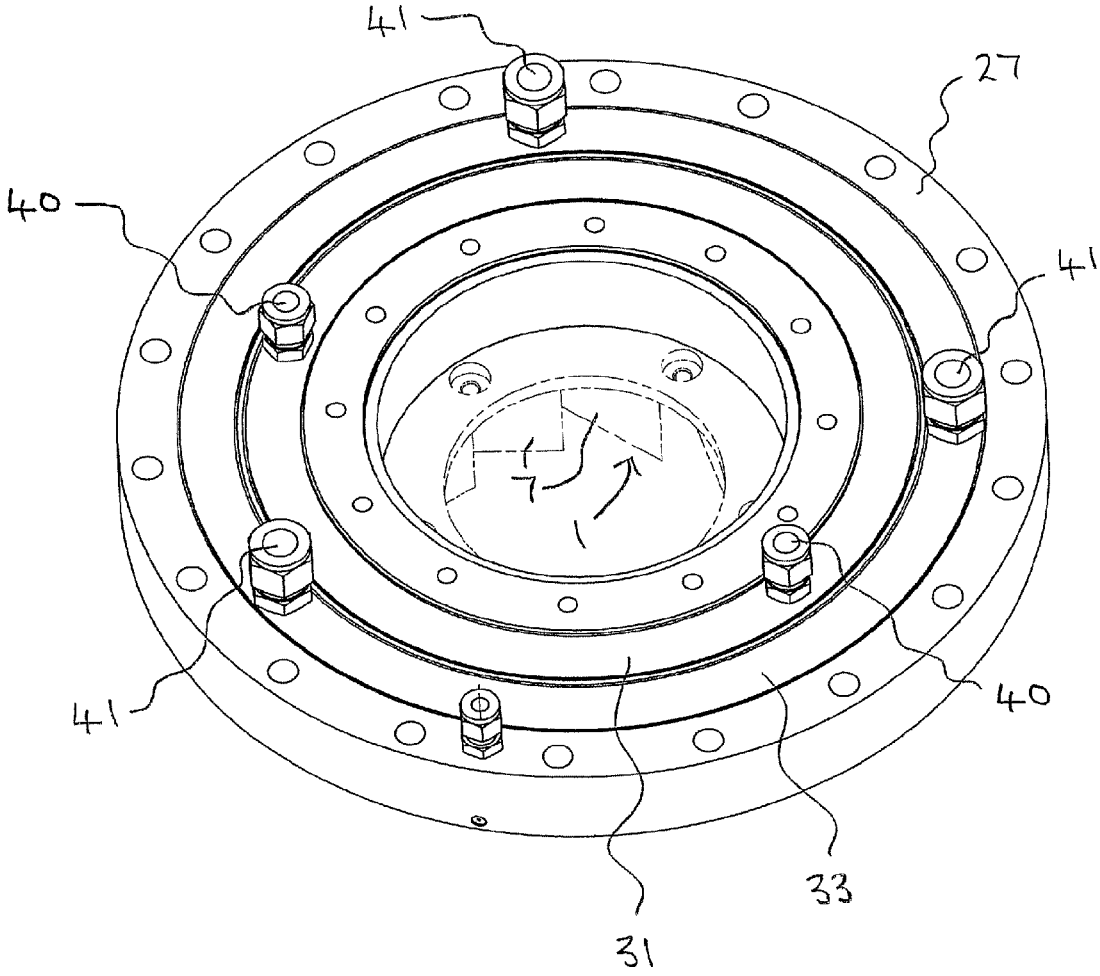
FIG. 3 is a view taken from the underneath in FIG. 2, as indicated by the arrow III in FIG. 2.

Reference will now be made to FIGS. 3 and 4. In FIGS. 3 and 4 radial swirler 1 is shown dashed. FIG. 4, in addition to showing radial swirler 1 and gas fuel supply manifold 27, also shows a part 29 of the burner for supplying pilot gas fuel to the burner. Part 29 is shown dashed.

Gas fuel supply manifold 27 comprises first and second independent gas fuel supply galleries 31, 33. First and second galleries 31, 33 are annular in form and supply gas fuel to first and second gas fuel injection holes 23, 25 respectively. First gallery 31 supplies gas fuel to first gas fuel injection holes 23 by way of passages 35 within gas fuel supply manifold 27 that communicate with first injection holes 23. Second gallery 33 supplies gas fuel to second gas fuel injection holes 25 by way of (i) passages 37 within gas fuel supply manifold 27, and (ii) passages 39 within vanes 7 of radial swirler 1 that communicate with second injection holes 25. Gas fuel inlets 40, 41 are substantially uniformly distributed around annular first and second gas fuel supply galleries 31, 33 respectively to ensure a uniform distribution of gas fuel around the galleries.

Figure 4A:
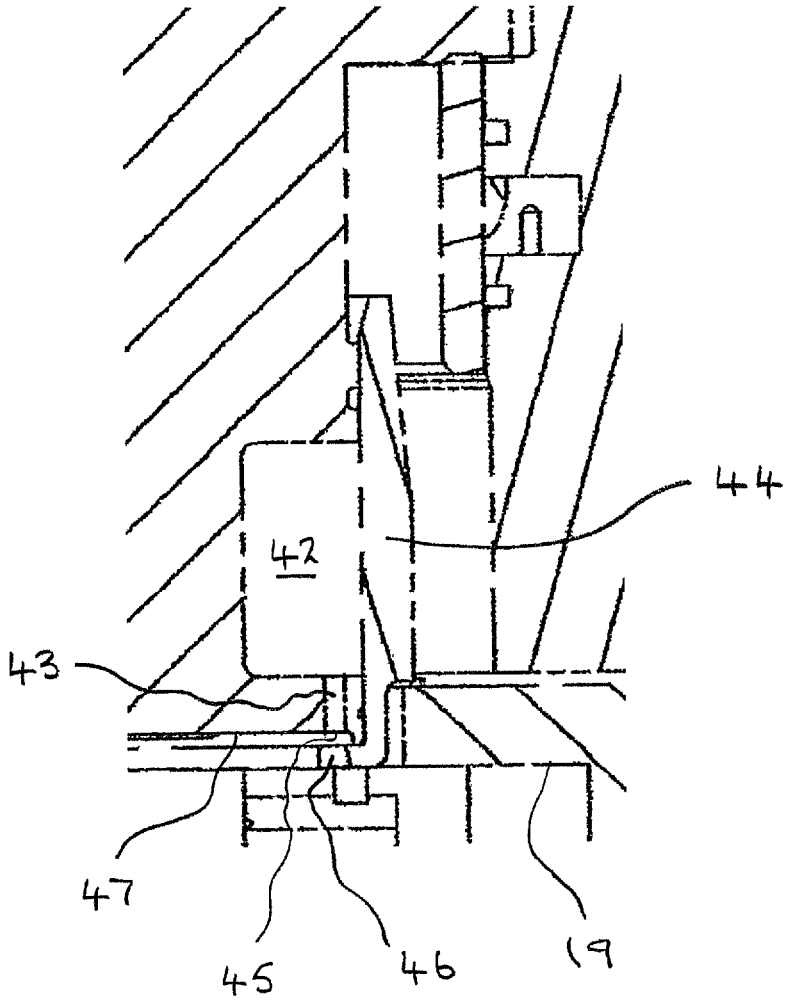

Reference is now also to be made to FIG. 4*a*. Pilot gas fuel is supplied to the burner by means of a number of pilot gas fuel injection holes 45 that are spaced around the circumference of a circular pilot face 47 of part 29 of the burner. One such hole 45 is shown in FIGS. 4 and 4*a*. Each hole 45 is supplied by a respective passage 43 in part 29 from an annular pilot gas fuel supply reservoir 42 of part 29. Part 29 also includes an annular shroud 44, an annular lip 46 of which lies just above the opening in pilot face 47 of pilot gas fuel injection holes 45. Lip 46 directs the pilot gas fuel from holes 45 over pilot face 47. Circular pilot face 47 and the bases 19 of flow slots 9 of radial swirler 1 lie substantially in the same plane.

FIG. 1 depicts the flame 49 present in the burner in use. Flame 49 can be considered as occupying three flame regions: a pilot flame region 51, a base injection flame region 53, and a side injection flame region 55. Pilot flame region 51 is located immediately adjacent circular pilot face 47, and is centred on the centre of circular pilot face 47. Pilot flame region 51 is predominantly supplied by fuel from pilot gas fuel injection holes 45 in circular pilot face 47. Base injection flame region 53 extends from pilot flame region 51 up the centre of the burner. Base injection flame region 53 is predominantly supplied by fuel from first gas fuel injection holes 23 in bases 19 of flow slots 9. Side injection flame region 55 is located radially outside base injection flame region 53. Side injection flame region 55 is predominantly supplied by fuel from second gas fuel injection holes 25 in first sides 15 of flow slots 9.

The burner in accordance with the present invention of FIGS. 1 to 4 achieves lower NOx and CO emissions by having greater flexibility as regards the amounts of gas fuel that can be injected via first and second gas fuel injection holes 23, 25, i.e. by having greater flexibility as regards the amounts of gas fuel that can be supplied to base and side injection flame regions 53, 55. This greater flexibility is afforded by the first and second gas fuel injection holes 23, 25 each having their own independent gas fuel supply gallery 31, 33, i.e. the first gas fuel injection holes 23 are exclusively supplied by gas fuel from first gas fuel supply gallery 31, and the second gas fuel injection holes 25 are exclusively supplied by gas fuel from second gas fuel supply gallery 33. In this regard, in the known burner referred to earlier, both the first and second gas fuel injection holes are supplied by gas fuel from one and the same gas fuel supply gallery. Thus, in the burner according to the invention of FIGS. 1 to 4, the amounts of gas fuel injected via the first and second gas fuel injection holes can be varied independently, whereas in the known burner the amounts are always in fixed proportion as determined by the ratio of the hole sizes of the first and second holes (and this ratio is usually chosen to be optimum for full load operation of the gas turbine engine).

It will now be explained how lower NOx and CO is achieved by the possibility to vary independently the amounts of gas fuel injected by first and second gas fuel injection holes 23, 25.

In the graph of FIG. 5 there are three plots in respect of the known burner: (i) a plot of how the amount of fuel supplied by the pilot gas fuel injection holes (expressed as a percentage of the total amount of fuel supplied to the burner) is varied with gas turbine engine load (the square point plot), (ii) a plot of how the amount of fuel supplied by the first gas fuel injection holes (expressed as a percentage of the total amount of fuel supplied to the burner) is varied with gas turbine engine load (the triangle point plot), and (iii) a plot of how the amount of fuel supplied by the second gas fuel injection holes (expressed as a percentage of the total amount of fuel supplied to the burner) is varied with gas turbine engine load (the circle point plot).

The graph of FIG. 5 can be termed a running map for operation of the known burner. It can be seen that the amounts of gas fuel supplied to the base and side injection flame regions remain in the same proportion to one another notwithstanding variation in gas turbine engine load (the amount supplied to the base region is always approximately 0.25 of that supplied to the side region). This is because the first and second gas fuel injection holes are supplied by one and the same gas fuel supply gallery.

The graph of FIG. 6 corresponds to that of FIG. 5 but is for the burner according to the invention of FIGS. 1 to 4. Thus, in the graph of FIG. 6 there are three plots in respect of the burner of FIGS. 1 to 4: (i) a plot of how the amount of fuel supplied by the pilot gas fuel injection holes 45 (expressed as a percentage of the total amount of fuel supplied to the burner) is varied with gas turbine engine load (the square point plot), (ii) a plot of how the amount of fuel supplied by the first gas fuel injection holes 23 (expressed as a percentage of the total amount of fuel supplied to the burner) is varied with gas turbine engine load (the triangle point plot), and (iii) a plot of how the amount of fuel supplied by the second gas fuel injection holes 25 (expressed as a percentage of the total amount of fuel supplied to the burner) is varied with gas turbine engine load (the circle point plot).

Again, the graph of FIG. 6 can be termed a running map for operation of the burner of FIGS. 1 to 4. It can be seen that the amounts of gas fuel supplied to the base and side injection flame regions 53, 55 no longer remain in the same proportion to one another, but vary independently of one another with variation in gas turbine engine load. This independent variation is possible because the first and second gas fuel injection holes 23, 25 supplying the base and side regions 53, 55 each have their own independent gas fuel supply gallery 31, 33.

It can be seen from FIG. 6 that the possibility to vary independently the base and side supplies has been used to modify the running map of FIG. 5 in a way that would not have been possible if the supplies must remain in the same proportion. The modification is below gas turbine engine loads of approximately 80 percent, and the degree of modification increases the lower the load. The modification comprises a very substantial increase in the base supply, a modest decrease in the side supply, and a substantial decrease in the pilot supply. The very substantial increase in the base supply enables the substantial decrease in the pilot supply. The substantial decrease in the pilot supply results in a significant reduction in NOx and CO.

FIG. 7 shows the predicted significant reductions in NOx and CO. The graph of FIG. 7 comprises four plots: (i) a plot of NOx versus gas turbine engine load for the known burner operated according to the running map of FIG. 5 (the dotted line and white square plot), (ii) a plot of CO versus gas turbine engine load for the known burner operated according to the running map of FIG. 5 (the dotted line and white circle plot), (iii) a plot of NOx versus gas turbine engine load for the burner of FIGS. 1 to 4 operated according to the running map of FIG. 6 (the solid line and black square plot), and (iv) a plot of CO versus gas turbine engine load for the burner of FIGS. 1 to 4 operated according to the running map of FIG. 6 (the solid line and black circle plot). It can be seen that there is a reduction in NOx and CO for engine loads less than approximately 60 percent, and that the amount of the reduction increases with decreasing load.

It need not be the case that each and every flow slot in the circle of flow slots comprises the first gas fuel injection hole and the two second gas fuel injection holes. It could be that only every other flow slot around the circle comprises the first and second gas fuel injection holes. Alternatively, it could be that every other flow slot comprises the first gas fuel injection hole only, and the flow slots in between these flow slots comprise the two second gas fuel injection holes only. In both cases, the first and second gas fuel injection holes would each be supplied by their own independent gas fuel supply gallery, as galleries 31, 33.

A comparison of the graphs of FIGS. 5 and 6 shows that a proportion of the pilot supply in FIG. 5 has been replaced by base supply in FIG. 6. This reduces NOx and CO as the base supply is at least partially already mixed with air when it reaches the flame area of the burner, whereas the pilot supply is not. The replacement also increases the stability of combustion in the burner for the same reason.

The invention claimed is:

1. A burner for a gas turbine engine, comprising:

a radial swirler to create a swirling fuel/air mix, the radial swirler, comprising a plurality of vanes arranged in a circle, a plurality of radially inwardly extending flow slots defined between adjacent vanes in the circle;

a combustion chamber in which combustion of the swirling fuel/air mix occurs; and a pre-chamber located between the radial swirler and the combustion chamber, wherein each flow slot includes a radially outer inlet end, a radially inner outlet end, first and second generally radially inwardly extending sides provided by adjacent vanes, a base and a top, wherein air travels along the plurality of flow slots from the inlet ends to the outlet ends and combines with gas fuel and creates the swirling fuel/air mix adjacent to the outlet ends, wherein each flow slot comprises a first gas fuel injection hole in the base and a second gas fuel injection hole in the first side, wherein an amount of gas fuel injected via the first and second gas fuel injection holes are independently variable, wherein a circular pilot face is located within the circle of the plurality of vanes, wherein a plurality of pilot gas fuel injection holes are spaced around a circumference of the circular pilot face, wherein the first gas fuel injection holes are supplied with gas fuel from a first gas fuel supply gallery, wherein the second gas fuel injection holes are supplied with gas fuel from a second gas fuel supply gallery independent of the first gas fuel supply gallery, wherein the burner further comprises an annular shaped gas fuel supply manifold which comprises the first and second gas fuel supply galleries, wherein the first gas fuel supply gallery supplies gas fuel to the first gas fuel injection holes by way of first passages within the gas fuel supply manifold that communicates with the first gas fuel injection holes, and wherein the second gas fuel supply gallery supplies gas fuel to the second gas fuel injection holes by way of second passages within the gas fuel supply manifold that communicate with the second gas fuel injection holes via third passages within the vanes of the radial swirler, the second passages being separate from the first passages.

2. A burner as claimed in claim 1, wherein each flow slot comprises the first gas fuel injection hole in the base and the second gas fuel injection hole in the first side.

3. A burner as claimed in claim 2, wherein each flow slot comprises two second gas fuel injection holes in the first side.

4. A burner as claimed in claim 2, wherein in each flow slot the first gas fuel injection hole is located at the inlet end of the flow slot and the second gas fuel injection hole is located adjacent to both the inlet end and the top.

5. A burner as claimed in claim 3, wherein in each flow slot the first gas fuel injection hole is located at the inlet end of the flow slot and the second gas fuel injection holes are located adjacent to both the inlet end and the top.

6. A burner as claim in claim 5, wherein in each flow slot the two second gas fuel injection holes are located one above the other.

7. A burner as claimed in claim 1, wherein the first and second gas fuel supply galleries are annular in form.

8. A burner as claimed in claim 7, wherein a plurality of gas fuel inlets to the annular first and second gas fuel supply galleries are substantially uniformly distributed around the first and second gas fuel supply galleries to ensure a uniform distribution of gas fuel around the galleries.

9. A burner as claimed in claim 1, wherein the plurality of bases of the plurality of flow slots and the circular pilot face lie substantially in the same plane.

* * * * *